US010518318B2

(12) United States Patent
Niebling et al.

(10) Patent No.: US 10,518,318 B2
(45) Date of Patent: Dec. 31, 2019

(54) DEVICE AND METHOD FOR PRODUCING INGOTS

(71) Applicant: ALD VACUUM TECHNOLOGIES GMBH, Hanau (DE)

(72) Inventors: Arno Niebling, Linsengericht (DE); Jochen Flinspach, Hanau (DE)

(73) Assignee: ALD VACUUM TECHNOLOGIES GMBH, Hanau (DE)

( * ) Notice: Subject to any disclaimer, the term of this patent is extended or adjusted under 35 U.S.C. 154(b) by 226 days.

(21) Appl. No.: 15/572,266

(22) PCT Filed: May 9, 2016

(86) PCT No.: PCT/EP2016/060330
§ 371 (c)(1),
(2) Date: Nov. 7, 2017

(87) PCT Pub. No.: WO2016/180777
PCT Pub. Date: Nov. 17, 2016

(65) Prior Publication Data

US 2018/0290205 A1 Oct. 11, 2018

(30) Foreign Application Priority Data

May 8, 2015 (DE) ..... 10 2015 107 258

(51) Int. Cl.
*B22D 11/128* (2006.01)
*B22D 11/00* (2006.01)
*B22D 11/14* (2006.01)

(52) U.S. Cl.
CPC ..... *B22D 11/1281* (2013.01); *B22D 11/001* (2013.01); *B22D 11/141* (2013.01)

(58) Field of Classification Search
CPC ..... B22D 1/00; B22D 11/00; B22D 11/001; B22D 11/128; B22D 11/1281; B22D 11/14; B22D 11/141; B22D 21/00
USPC ..... 164/469, 474, 475, 415
See application file for complete search history.

(56) References Cited

U.S. PATENT DOCUMENTS

2004/0056394 A1 3/2004 Jackson et al.

FOREIGN PATENT DOCUMENTS

| | | | |
|---|---|---|---|
| DE | 1558248 | A1 | 3/1970 |
| DE | 102014100976 | A1 | 9/2014 |
| EP | 2394758 | A1 | 12/2011 |
| GB | 720205 | | 12/1954 |
| GB | 720205 | A | 12/1954 |
| GB | 2512991 | A | 10/2014 |
| JP | 2014516316 | A | 7/2014 |
| JP | 2014172093 | A | 9/2014 |
| WO | WO2010090313 | A1 | 8/2010 |
| WO | 2012138456 | A1 | 10/2012 |
| WO | WO2012138456 | A1 | 10/2012 |

*Primary Examiner* — Kevin P Kerns
(74) *Attorney, Agent, or Firm* — Hudak, Shunk & Farine Co. LPA

(57) ABSTRACT

A method and a device for producing ingots from metal or metal alloy. The method and the device are suitable for producing ingots from nickel, titanium, vanadium, niobium, tantalum, zirconium, hafnium, or alloys thereof and alloys of the metals in continuous casting methods. The device has an ingot chamber, which is suitable for receiving multiple cast ingots and for allowing the ingots to cool in the ingot chamber. For this purpose, the ingots are arranged in the ingot chamber in a horizontally movable manner on ingot tube section.

16 Claims, 5 Drawing Sheets

DEVICE AND METHOD FOR PRODUCING INGOTS

FIELD OF THE INVENTION

The present invention relates to a device and to a method for producing ingots from metal or metal alloy. In particular, the method is a continuous casting method.

BACKGROUND OF THE INVENTION

The invention relates to a method and a device for producing ingots from metal or metal alloy. The method and the device are particularly suitable for producing ingots from nickel, titanium, vanadium, niobium, tantalum, zirconium, hafnium, or alloys thereof and alloys with said metals in continuous casting methods. The device has an ingot chamber, which is suitable for receiving multiple cast ingots and for allowing the ingots to cool in the ingot chamber. For this purpose, the ingots are arranged in the ingot chamber in a horizontally movable manner on ingot holding means.

Devices for the production of ingots are known from the prior art in a large number of embodiments. In the known continuous casting methods, an ingot is generally cast with the aid of a permanent mold and is then allowed to cool. In the case of reactive metals or metal alloys, the ingot must not come into contact with air immediately after casting since, otherwise, oxides or other reaction products with components of the air can form, and this can considerably impair the quality of the product. This applies especially to titanium and titanium alloys. Operations are therefore carried out under an inert gas atmosphere or in a vacuum.

The productivity of continuous casting methods is conventionally limited by the fact that, before casting another ingot, it is necessary to wait until the first ingot has cooled down sufficiently for it to be removed from the plant without reacting with components of the air. In the case of the comparatively short process times, which are generally between 30 and 90 minutes, for casting an ingot, cooling times are particularly significant.

GB 720,205 A relates to a method for producing ingots from steel by continuous casting. A gastight ingot chamber is not disclosed.

Various ways of solving this problem have been tried. Thus, DE 10 2014 100 976 A1, for example, discloses a continuous casting device and a pseudo-continuous method for producing ingots, but this entails a number of disadvantages. Thus, in the device described there, it is necessary to guide a cast ingot over a multiplicity of rollers (reference signs 60, 71). Moreover, the ingot is clamped by means of clamping devices (55A, 55B) in order to fix the ingot in a cutting device. All this makes the device complex overall and impairs the surface quality of the ingot owing to the contact between the ingot surface and the material of the rollers and the clamping device. Moreover, the cutting device used in the device gives rise to chips and metal waste which interfere with smooth progress of the process. Not least, the necessity of additional chambers gastightly separated from the ambient air increases the outlay on apparatus enormously. Thus, DE 10 2014 100 976 A1 admittedly discloses a device in which the stoppage of the casting process is not determined by the cooling of the cast ingot but by the separation of the cast ingot from the subsequent ingot and the required gas exchange times of the unloading chamber. However, this increase in throughput is produced at the expense of a complex plant design with inherent problems.

DE 1 558 248 A describes a device for conveying cut-off cast blocks during continuous metal casting. There, the cast blocks obtained are placed on a carriage after cooling and carried away. In particular, the device described there does not have an ingot chamber with a plurality of ingot holding means.

Another approach to increasing throughput when producing ingots from metal or a metal alloy is disclosed in WO 2012/138456 A1. There, an apparatus design is described which allows a melt to be cast in more than one mold. This opens up the possibility of using two ingot molds with one melting point. While one ingot is cooling down in the first mold, the second can already be in the process of being molded. However, such a system entails disadvantages, namely the casting time for the second ingot is not sufficient to enable the first ingot to cool down sufficiently for it to be removed safely. US 2004/0056394 A1 likewise describes a device with two casting strands. The device does not have an ingot chamber suitable for receiving a plurality of ingots.

The parallel operation of several melting points has also been proposed in the prior art. However,—at least in the case of plasma systems—this is associated with the need to provide a correspondingly large number of heating means since a plasma torch cannot simultaneously keep a plurality of melting points molten owing to its relatively slow movement. Moreover, many methods envisage unloading steps which require that the process chambers be flooded with air. As a result, it is necessary to evacuate them again or flood them with inert gas before the next method step, making the process uneconomic.

It is generally advantageous if a device for producing ingots from metal or metal alloy is as simple as possible in construction and, as a result, involves little maintenance. In particular, there should only be a small number of moving parts in the interior of the chambers. For exchange or repair, namely, operation must be interrupted; often, repair is possible only under particularly strict safety conditions. Moreover, a simple construction makes it possible to keep the volume to be evacuated or to be filled with inert gas small, and this, in turn, lowers costs.

SUMMARY OF THE INVENTION

It is therefore the object of the present invention to make available a device and a method for producing ingots from metal or metal alloy which is suitable for increasing the productivity of production and, at the same time, does not excessively increase the complexity of the plant. Furthermore, the ingots produced should be at least equivalent in quality to or better than those in the prior art.

The object is achieved by the subjects of the patent claims.

A device for producing ingots from metal or metal alloy, having at least one melting device, at least one permanent mold, at least one ingot chamber, which is arranged at least partially underneath the permanent mold, wherein the ingot chamber has a plurality of ingot holding means, which are suitable for receiving at least one ingot in each case, wherein the ingot holding means are horizontally movable, in particular about a substantially vertical axis of rotation, with the result that an ingot holding means can be moved to a melting position underneath the permanent mold to receive an ingot, and can then be moved to a different location in order to free the melting position for another ingot holding means, wherein the permanent mold is arranged in such a way that molten metal or metal alloy can be fed to it from the melting device is in accordance with the invention.

The device according to the invention makes it possible to move a cast ingot that quickly out of the region underneath the permanent mold to enable the casting process for the next ingot to be started without having to wait for the cooling of the ingot cast first. For this purpose, the ingot holding means, in which an ingot can be arranged, are of movable design. The mobility of the ingot holding means can preferably be achieved by arranging the ingot holding means on or in a movable plate. In particular, the plate is rotatable, e.g. a turntable with ingot holding means arranged therein. The rotatable plate can expediently be of circular design, wherein the ingot holding means are advantageously arranged in a ring shape around the axis of rotation.

It has proven advantageous to design the ingot holding means in such a way that they hold the respective ingot only in the bottom region thereof, in particular at the starter block thereof. As a result, the ingot remains largely uncovered in the ingot chamber, as a result of which the cooling of the ingot can take place relatively quickly. In some cases in the prior art, ingot molds are provided into which the ingot is cast. These molds are then either cooled by means of coolant or lead to retardation of cooling. The preference is not to provide such molds in the device of this invention in order to reduce the outlay on maintenance, to minimize the complexity of the plant and not to impair cooling. Only in an alternative embodiment is it possible to provide the ingot holding means with a wall which is suitable for at least partially surrounding a cast ingot. This wall can be of cooled or heated design, depending on whether the cooling is to be accelerated or retarded. A resistance heater is preferred as a heating means. In terms of apparatus, this can be achieved, in particular, by using tube sections, which, in particular as regards height and diameter, are matched to the ingot. Heating the walls of a modified ingot holding means of this kind can be advantageous if cracking of the ingot in the event of over-rapid cooling would otherwise be a risk.

The ingot holding means are, for example, tube sections, although it is also possible for different, in particular cylindrical or conical, holders to be involved. The holders or tube sections can be embodied with or without guiding grooves or guiding projections. Further examples of ingot holding means are rectangular holders or a number of rods arranged around the ingot. A cast ingot can then be arranged in an ingot holding means in such a way that it is fixed. After being arranged in the ingot holding means, it is then ideally only possible for the ingot to be lifted upward out of the ingot holding means again. For this purpose, the ingot holding means or holding means can be of conical or cylindrical design, for example (being designed as a tube section). In the case of the cylindrical design, it is preferred that the cast ingot have a section of smaller diameter than the rest of the ingot at its lower end, in particular in the region of the starter block. This design of the holding means ensures that the ingot is fixed at a precisely predetermined position, allowing it to be handled in a specifically intended manner, e.g. using the lifting devices described herein.

The device of this invention preferably comprises at least one unloading chamber, which is, in particular, arranged at least partially above the ingot chamber. The unloading chamber is preferably of gastight design. In particular, it has an opening in the direction of the ingot chamber, which is preferably designed in such a way that it can be closed gastightly with respect to the ingot chamber, in particular being a lock or a valve. The opening can be opened for the purpose of unloading an ingot from the ingot chamber. In the moment of opening, the unloading chamber is preferably filled with inert gas or evacuated, like the ingot chamber. The ingot is moved through the opening to the unloading point in the unloading chamber and fixed there. An inserted lifting device can then be retracted, and the opening leading to the ingot chamber is closed again. Only then can the ingot be removed from the unloading chamber, e.g. by means of a crane. In one embodiment, the ingot to be unloaded can be held at the unloading point by holding elements, which are advantageously situated on the door of the unloading chamber. The door can then be swung outward, making the ingot accessible for a crane, for example.

The device according to the invention preferably has at least one lifting device, which is suitable for forming a releasable connection to an ingot molded with the aid of the permanent mold and for guiding, in particular lowering, the ingot that has just been cast into the ingot holding means in the melting position. In particular, the releasable connection is a clamped connection. However, other connections, e.g. screwed or plugin connections, are also conceivable.

The device according to the invention furthermore preferably has at least one second lifting device, which is suitable for moving, in particular lifting, an ingot out of an ingot holding means, situated at the unloading position in the ingot chamber, to the unloading point in the unloading chamber. For this purpose, the second lifting device is preferably designed in such a way that it can enter into a releasable connection to the ingot to be unloaded. The releasable connection is preferably the same type of connection as in the first lifting device, in particular a clamped connection. In particular, the unloading position is directly underneath the unloading chamber in the ingot chamber, in particular directly underneath an opening of the unloading chamber.

Consequently, the device according to the invention is suitable for casting an ingot, which, in particular, can be arranged in the melting position in an ingot holding means with the aid of a first lifting device, with the result that the cast ingot is arranged in the movable ingot holding means. The movable ingot holding means can be moved out of the region underneath the permanent mold (melting position), thus allowing another ingot to be cast. At this point in time, the ingot cast first is preferably still in the ingot chamber. The next ingot cast is, in turn, lowered into the next free ingot holding means, which is now situated in the melting position. In this way, it is possible successively to produce a plurality of ingots, each of which can be arranged in the next free ingot holding means.

Depending on how large the plant can be made and how much time is required for cooling, a different number of ingot holding means can be provided in the ingot chamber. It is particularly advantageous that the ingot chamber designed in this way does not require guide rollers or the like. The ingots are preferably held in their position solely by the ingot holding means. Qualitative impairment of the ingot surface by other contact elements is thereby avoided in an effective manner. Moreover, an ingot which is arranged vertically in the ingot chamber can cool down relatively uniformly.

Preferred embodiments relate to devices having at least four ingot holding means, as a further preference at least six ingot holding means, more preferably at least eight ingot holding means, as a further preference twelve or sixteen ingot holding means. At each point in time, there is preferably precisely one ingot holding means in the melting position and precisely one ingot holding means in the unloading position. In the case of eight ingot holding means, there is at a point in time during the process at which four ingots have already been cast, for example, precisely one ingot holding means in the melting position, one ingot holding means in the unloading position and three cooling ingots in their ingot holding means in between in the direction of movement from the melting position to the unloading position. In the direction of movement from the unloading position to the melting position, there are then three ingot holding means without ingots but possibly with starter blocks arranged therein.

As soon as an ingot in an ingot holding means has reached the unloading position through the movement thereof within the ingot chamber, this ingot can be raised from the ingot holding means to an unloading position in the unloading chamber, preferably by means of the second lifting device. In comparison with removal in some other way, especially with lowering, raising the ingot to be unloaded from the ingot holding means in the unloading position has the advantage that the ingot holding means can be of relatively simple design. For example, the ingot holding means can be of simple conical design or can be designed as a tube section. It is thereby easily possible to ensure that the ingot in an ingot holding means is movable only in one direction, namely upward.

The device according to the invention has a melting device, which has at least one heating means. Preferred heating means are selected from a plasma torch and/or an electron beam gun. The melting device is preferably arranged in a melting chamber. The melting chamber preferably comprises the melting device with at least one heating means and at least one permanent mold. Compared with alternative attempts to increase the productivity of devices for producing ingots from metal or metal alloys, the device of the present invention is distinguished by the fact that there is no absolute need for a plurality of permanent molds to increase productivity. Nevertheless, the present invention also includes embodiments which have more than one permanent mold, in particular two, three, four or more permanent molds. Devices which have more than one permanent mold require the presence of further heating means.

According to the invention, the melting chamber is preferably arranged at least partially above the ingot chamber. This allows a cast ingot to be transferred relatively directly into the ingot chamber.

The device according to the invention is suitable for producing ingots which must be produced while excluding air. This applies especially to reactive metals and metal alloys such as titanium and titanium alloys. Preferred metals are Ni, Ti, V, Nb, Ta, Zr, Hf and alloys thereof and alloys with these metals. Particularly preferred materials are titanium aluminides (TiAl). Consequently, the ingot chamber is preferably of gastight design. The same preferably applies to the unloading chamber and/or the melting chamber. To accelerate the method, the ingot chamber can have coolant-cooled walls.

The ingots which can be obtained with the device and the method of this invention preferably have a round, in particular circular, cross section. However, the cross section can also be rectangular, in particular square, or polygonal (>4-cornered). However, other shapes are also conceivable and in accordance with the invention. For a person skilled in the art, it is apparent that the basic shape of the ingot is not decisive for the mode of operation of the invention. It is furthermore possible to adapt the ingot holding means to the ingot shape by conventional means.

The ingot holding means in the device of the present invention are preferably suitable for receiving precisely one ingot in each case. In order to be able to make the ingot holding means and the procedure in general as efficient as possible, it has proven advantageous to use "starter blocks" to produce the ingots. The starter blocks are preferably arranged in the ingot holding means before the start of the melt.

The starter block preferably comprises those means which are required to hold the cast ingot body in position in the ingot holding means. In particular, the starter block is designed in such a way, especially in respect of its shape, that it allows the ingot to be fixed in the holding means. The ingot is preferably held in its ingot holding means exclusively by means of the starter block.

The starter block is preferably produced at least partially, in particular completely, from the same material as the ingot body. If the starter block is composed only partially of the same material as the ingot body, this preferably applies at least to the region which comes into contact with the melt during casting. The starter block and the ingot body preferably form the ingot. The starter block can preferably be arranged in the ingot holding means situated in the melting position even before the casting of the first ingot. The starter block is then raised into the permanent mold for the casting of the first ingot, thus allowing the ingot body to form by casting the melt onto the starter block. Once the ingot body has been fully cast, the starter block together with the ingot body is lowered into the ingot holding means in the melting position, with the result that the upper end of the ingot body is released from the permanent mold and the cast strand is thus separated. The starter block then remains connected to the ingot body. It is conveyed together with the ingot body into the unloading chamber. The starter block is preferably separated from the ingot body only after the ingot has been unloaded, and it can then be reused. The starter block is preferably composed of the same metal or the same metal alloy as the ingot body.

In the unloading chamber, the starter block removed together with the ingot body as a finished ingot can be replaced by a different starter block. The new starter block is then preferably lowered out of the unloading chamber, in particular by means of the second lifting device, into the ingot chamber and onto the free ingot holding means in the unloading position and is available for the production of another ingot body.

The unloading chamber brings the advantage that the ingot chamber does not have to be flooded with air to unload an ingot. On the contrary, the melting process can continue since the unloading chamber serves, as it were, as a lock for the removal of the ingot.

The use of starter blocks involves various advantages. Thus, for example, the starter block preferably already includes a fixing element, in particular clamping element, which is suitable for the formation of a releasable connection to the lifting devices. Furthermore, the starter block can be pre-shaped in a specific manner in such a way that it fits precisely into the ingot holding means of the ingot chamber. Following the removal of a finished ingot from the device, the starter block can be separated from the ingot body and taken for reuse.

As described, each ingot preferably has an ingot body and a starter block. The starter block furthermore preferably has at least one fixing element. With the aid of the fixing element, the starter block can preferably enter into a releasable connection to one or more lifting devices. For this purpose, the lifting device or lifting devices preferably has/have one or more fixing units, which are suitable for forming a releasable connection between the lifting device and the ingot, in particular the fixing element of a starter block. The fixing unit on the lifting device and the fixing element on the starter block are preferably suitable for bringing about a releasable connection by clamping. Stub clamping is preferred here.

The first lifting device preferably has at least one guiding means, which, in particular, has a length which exceeds the height of the ingot chamber, e.g. a rod or a tube. The guiding means can be moved in such a way from a location underneath an ingot holding means situated in the melting position that a starter block situated in the ingot holding means can be raised to the permanent mold, where the ingot body can be formed on the starter block. For this purpose, a fixing unit is preferably arranged on the upper end of the guiding means.

The lifting device is preferably suitable for lowering into the ingot holding means an ingot body formed on the starter block and situated directly underneath the permanent mold. Once the ingot has been lowered into the ingot holding means in the melting position, the releasable connection between the lifting device or guiding means is released, and the guiding means is preferably lowered sufficiently to enable the ingot holding means to be moved.

The sequence in the unloading position is similar. First of all, a releasable connection is preferably produced between the lifting device, in particular guiding means, and the ingot. The ingot is then preferably raised out of the ingot holding means into the unloading chamber. There, the ingot is preferably fixed to enable the releasable connection to be released. The guiding means is then lowered, allowing the opening between the unloading chamber and the ingot chamber to be closed.

A method for producing ingots from metal or metal alloy, in particular using the device described, comprising the following steps, is also according to the invention: melting a metal or a metal alloy, casting an ingot from the melt by means of a permanent mold, lowering the ingot out of the permanent mold onto an ingot holding means in an ingot chamber, while the ingot holding means is in a melting position, moving the ingot holding means, with the result that the ingot holding means occupied by the ingot frees the melting position for another, unoccupied ingot holding means, allowing the ingot to cool in the ingot holding means while the next ingot is being cast, moving the occupied ingot holding means to an unloading position in the ingot chamber, unloading the ingot from the ingot chamber at the unloading position.

The movement of the ingot out of the ingot holding means at the unloading position can be performed in such a way that the ingot is moved to an unloading point, which is situated in an unloading chamber. There is preferably a valve or a lock between the unloading chamber and the ingot chamber, thus making it possible to maintain the inert gas atmosphere or the vacuum in the ingot chamber when removing the ingot from the unloading chamber. The lock or the valve is opened to unload the ingot from the ingot chamber, and the ingot is passed through, in particular, by means of the lifting device. The ingot is held in the unloading chamber, thus allowing the lifting device to be retracted. The lock or valve is then closed again, and the ingot can be removed from the unloading chamber without the inert gas atmosphere or the vacuum in the ingot chamber being impaired.

As an alternative, the ingot to be unloaded can be unloaded through a valve or some other suitable opening in the ingot chamber. In such a case, it is advantageous first of all to load all the ingot holding means in the ingot chamber with ingots before unloading is carried out. Unloading can then include previous evacuation and/or flooding with air.

Where reference is made herein to a movement of the ingot holding means, this refers, in particular, to a horizontal movement, preferably a rotary movement, about a vertical axis.

The metal processed according to the invention or the metal alloy is preferably selected from Ni, Ti, V, Nb, Ta, Zr, Hf and alloys thereof and alloys with said metals. The method is preferably carried out under inert gas or in a vacuum; this applies especially to the atmosphere in the ingot chamber. Here, "vacuum" refers to a pressure which does not exceed 400 Pa, in particular 250 Pa and particularly preferably 100 Pa. Even if inert gas is used, operations are not necessarily carried out at atmospheric pressure; on the contrary, the pressure is preferably 500 to 1100 kPa, preferably below 1000 kPa, in particular below 800 kPa. The preferred inert gas is helium.

The ingots produced with the method according to the invention and the device preferably have a length of at least 1 m, more preferably 1.5 m and particularly preferably at least 2 m. A length of preferably 5 m, as a further preference 4 m and particularly preferably 3 m should not be exceeded for reasons connected with handling. The ingots preferably have a diameter of at least 50 mm, as a further preference at least 100 mm. A thickness of 400 mm, as a further preference 300 mm, should not be exceeded to avoid hindering cooling.

At the time of being unloaded, the ingots should not exceed a temperature of preferably 500° C., as a further preference 400° C., since otherwise there is a risk of the ingots reacting with atmospheric oxygen. The ingots preferably cool in the ingot chamber from a maximum of 3500° C., preferably a maximum of 3000° C., more preferably a maximum of 2500° C., in particular a maximum of 1500° C. or a maximum of 1200° C., to said unloading temperature. The ingot chamber preferably has a diameter of at least 1.5 m, more preferably at least 2 m and particularly preferably at most 4 m. In preferred embodiments, the ingot chamber is substantially of cylindrical shape, thus having a circular bottom surface.

With the device presented here and the method it is possible to achieve productivity increases of about 50% without the device being of particularly complex construction. The consumption of inert gas is furthermore reduced because the number and size of the chambers and the number of refills is small.

During a melting campaign, the process atmosphere in the ingot chamber can preferably be continuously maintained. It is thereby possible to reduce the changeover times between individual melts by several orders of magnitude. The cooling of the ingots can take place within the ingot chamber. Since unloading is preferably carried out only when a number of ingots (e.g. 3, 4, 5 or more) has been cast, this time is sufficient to remove the ingots without risk. Particularly in the case of short melting times, the conventional station changeover is too lengthy and the cooling times too short.

BRIEF DESCRIPTION OF THE DRAWINGS

FIG. 2 shows the device in a state with a starter block 12 raised into the permanent mold 21. For this purpose, the first lifting device 40 is shown in a position in which a lifting means 42 is situated directly underneath the ingot chamber bottom 17 and a guiding means 43 extends through the ingot chamber 10 as far as the permanent mold 21. The lifting means 42 is shown in the form of a lifting unit, which can be moved on a guide rod 44. In contrast, the second lifting device 40 is shown in a position in which a lifting means 42 is shown in the lowermost position. Here, the guiding means 43 is completely below the ingot holding means.

LIST OF REFERENCE SIGNS

Figure 1:
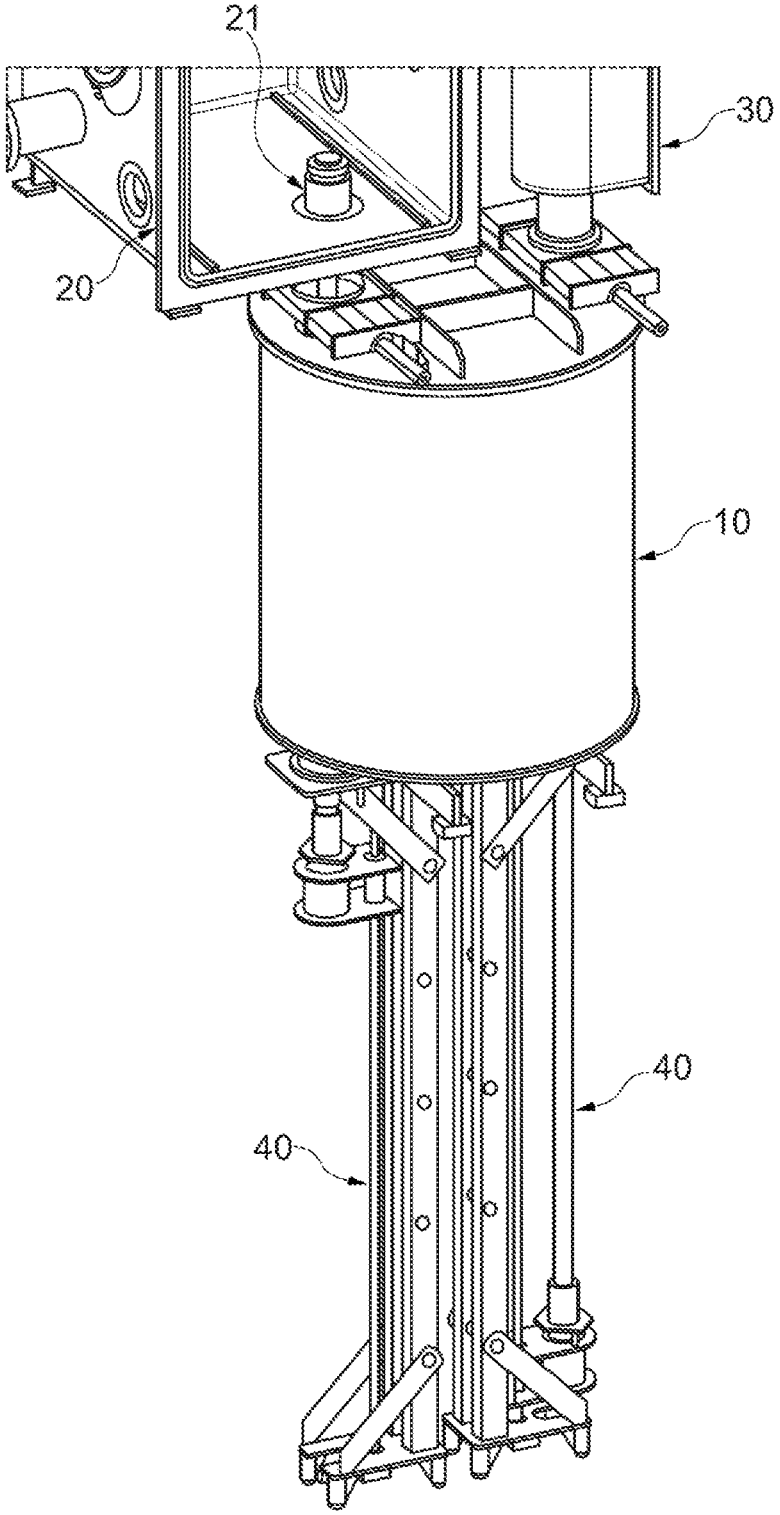
FIG. 1 shows a partial view of a device according to the invention with an ingot chamber 10, a melting chamber 20, an unloading chamber 30 and two lifting devices 40. The melting chamber 20 is arranged above the ingot chamber. The unloading chamber 30 is arranged above the ingot chamber 10. The lifting devices 40 are arranged underneath the ingot chamber 10. A permanent mold 21 is furthermore arranged in the melting chamber 20.
Figure 2:
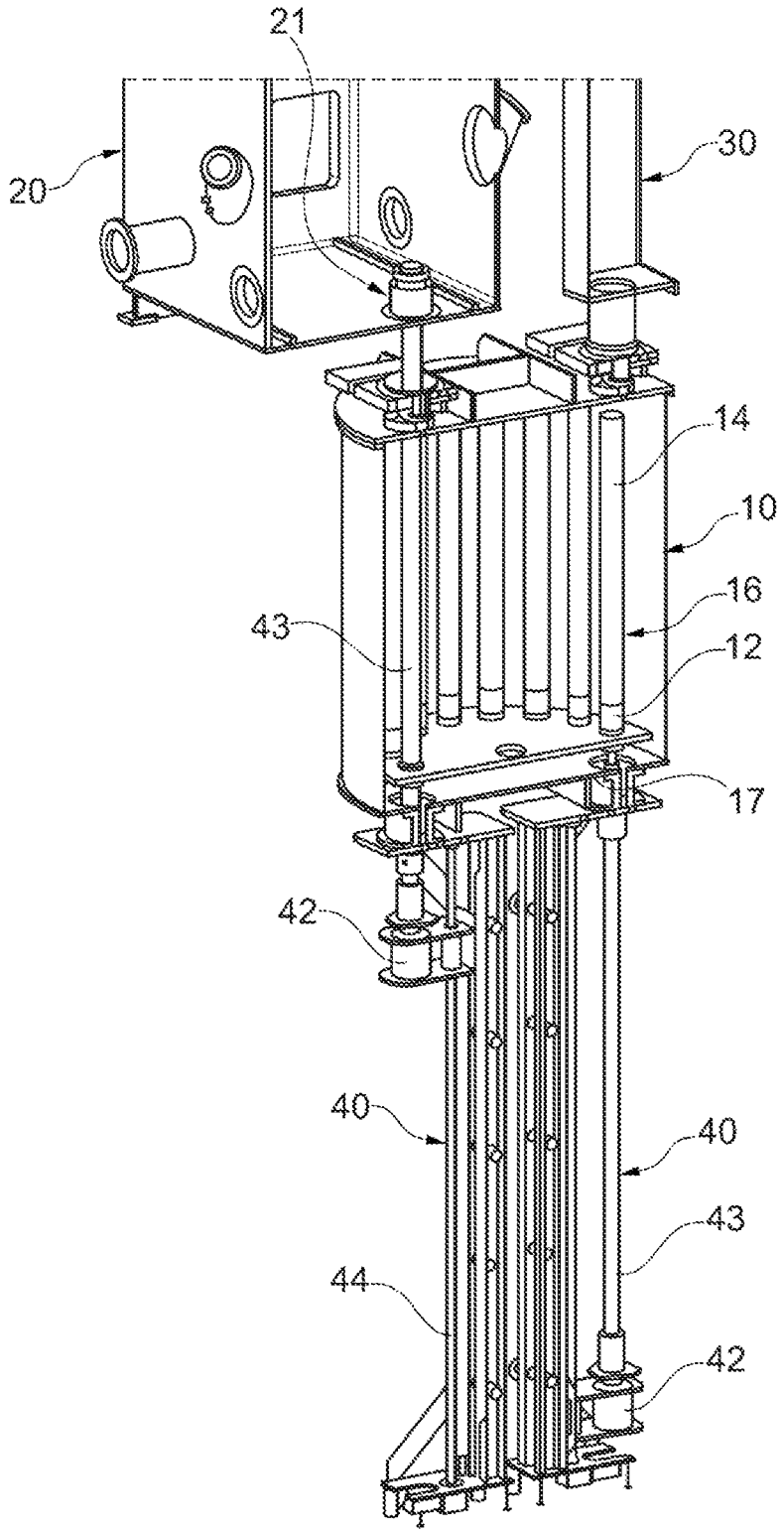
FIG. 2 shows the same device as that in FIG. 1 in section. Ingots 16 are shown within the ingot chamber 10, each ingot being composed of an ingot body 14 and a starter block 12.
Figure 3:
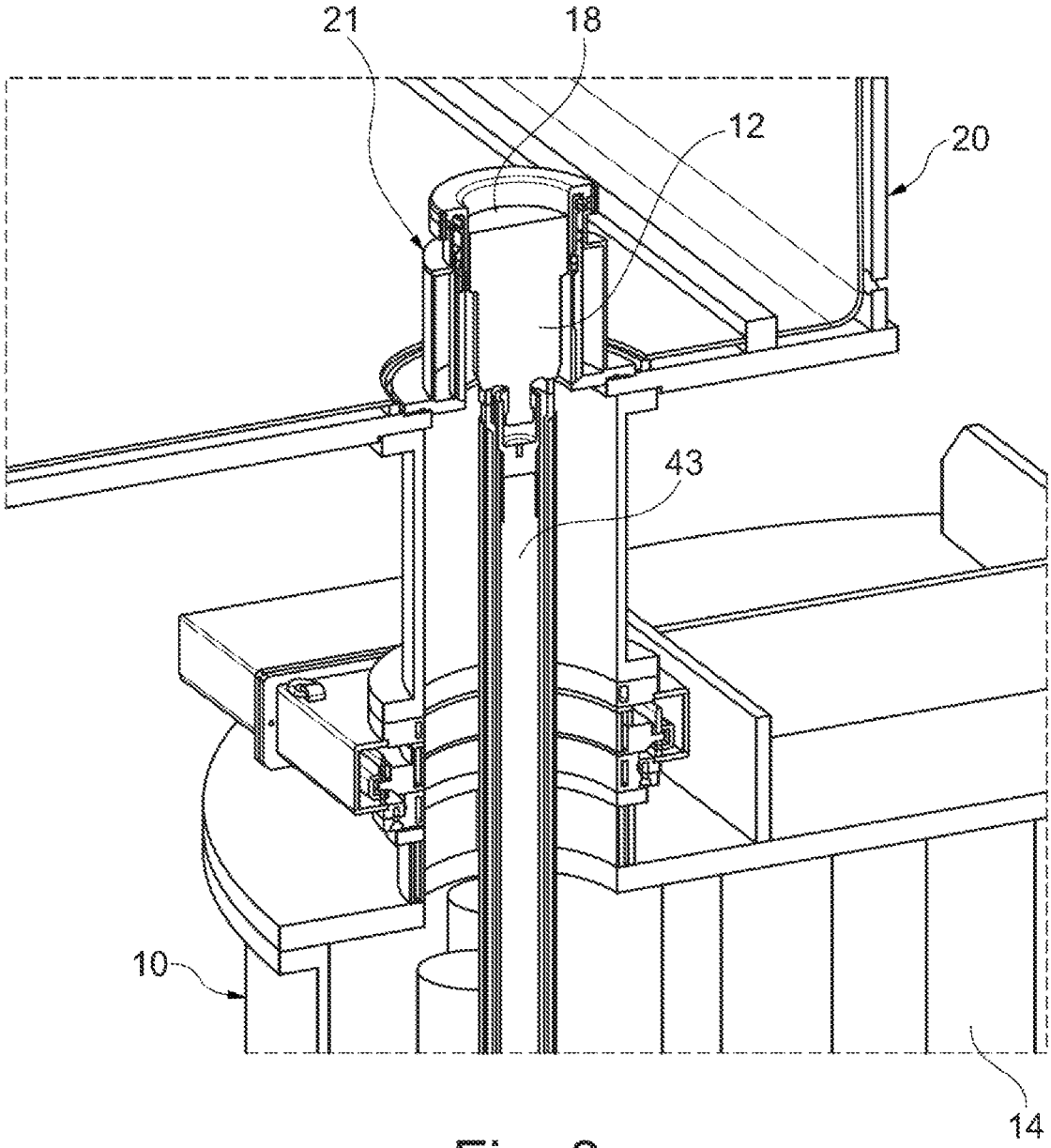
FIG. 3 shows a section through a starter block 12 in the permanent mold 21. The starter block 12 has been raised out of an ingot holding means (not shown) in the melting position into the permanent mold 21 with the aid of the guiding means 43 of the lifting device. In the course of the process, molten metal or metal alloy is poured onto the contact surface 18 of the starter block 12. There, the metal or metal alloy solidifies to form the ingot body, and, by means of the guiding means 43, the starter block 12 is moved successively downward until the starter block 12 reaches the ingot holding means. Even before reaching the ingot holding means, the further formation of the ingot body is stopped, it being possible to achieve this, for example, by interrupting the supply of material or the supply of heat. The fact that the lowering of the starter block 12 with the ingot body formed thereon into the ingot holding means is nevertheless continued ensures that the ingot body 14 produced separates and is obtained with a height which is less than the height of the ingot chamber 10.
Figure 4:
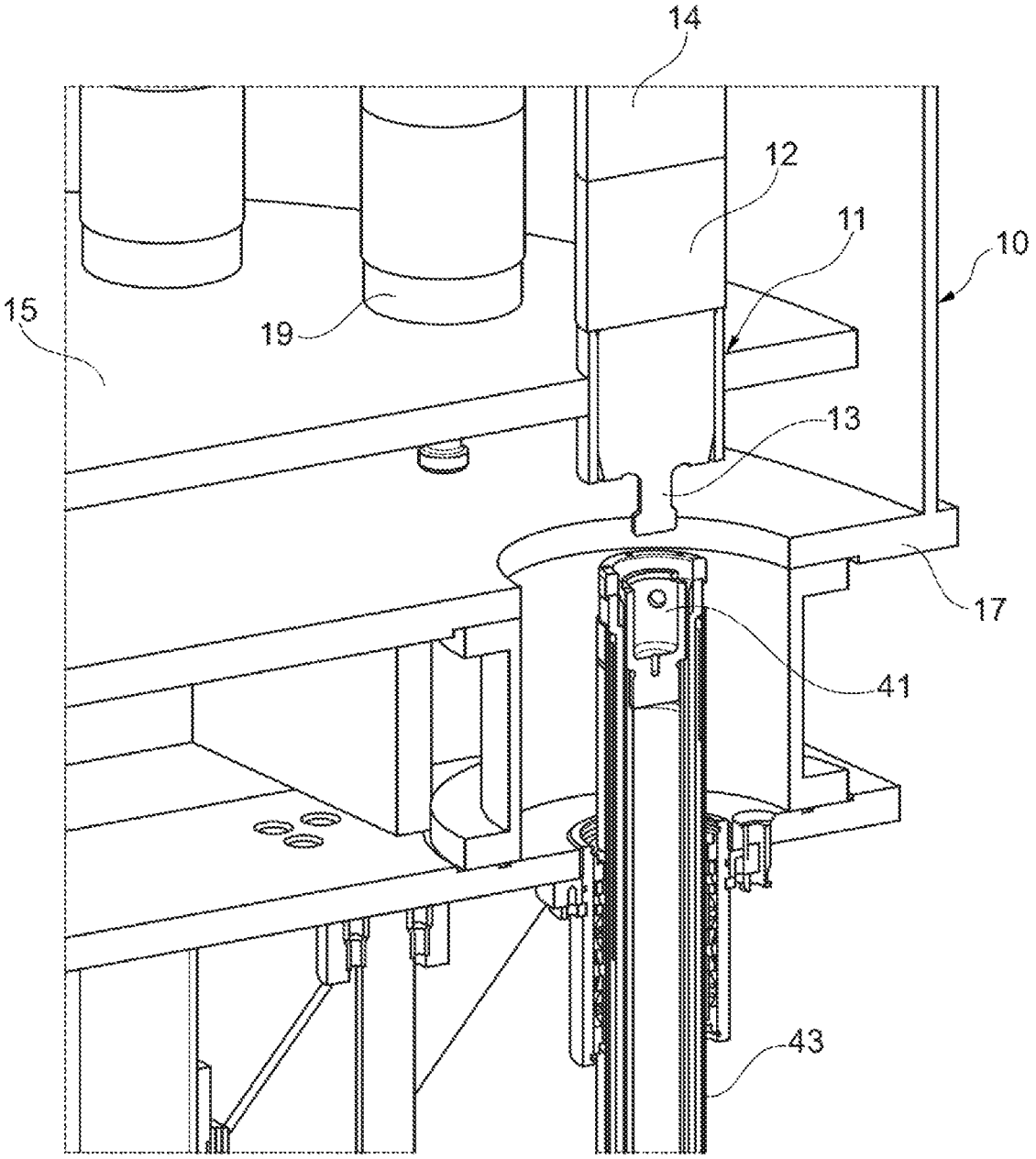
FIG. 4 shows a section in the lower region of the ingot chamber 10. Among the components shown is a rotatable plate 15, in which the ingot holding means 11 with the starter blocks 12 situated therein are arranged. The starter blocks 12 have fixing elements 13. It can be seen that the starter blocks 12 have a smaller diameter in the lower region than above it. As a result, the starter block 12 and, with it, the ingot body 14 is fixed by the holding means, in particular in the form of a tube section 19. The ingot cannot be moved to the sides or downward; on the contrary, it can only be lifted out upward. Also shown is the fixing unit 41 on the lifting device, which can enter into a releasable connection to a corresponding fixing element 13 on the starter block 12. It is furthermore apparent that the guiding means 43 is suitable for lifting the ingot out of the ingot holding means 11, wherein the guiding means 43 is moved through the ingot chamber bottom 17 and the ingot holding means 11.
Figure 5:
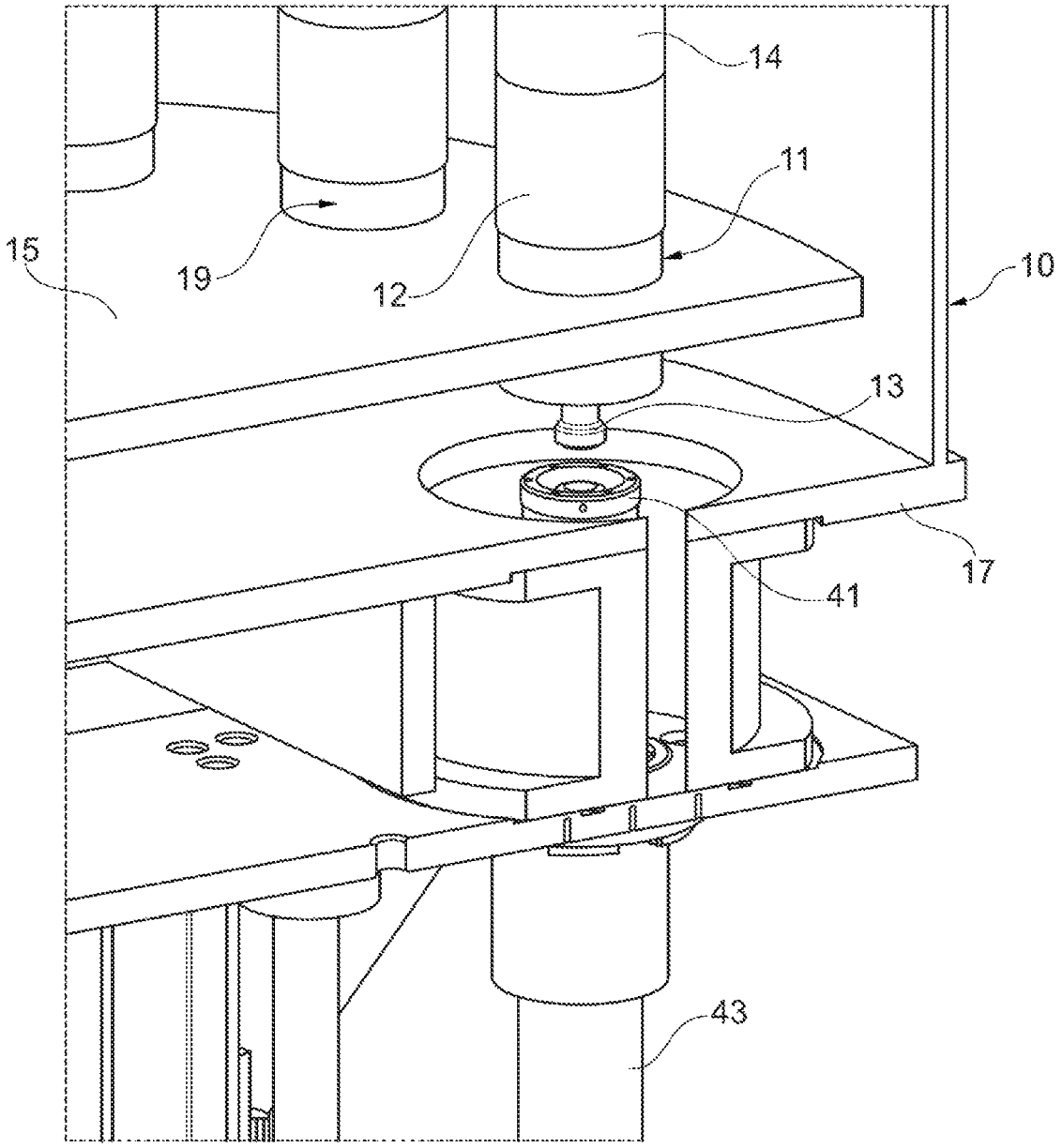
FIG. 5 shows substantially the same cutaway portion as FIG. 4 in a different section plane.

10—ingot chamber
11—ingot holding means
12—starter block
13—fixing element
14—ingot body
15—rotatable plate
16—ingot
17—ingot chamber bottom
18—contact surface
19—tube section
20—melting chamber
21—permanent mold
30—unloading chamber
40—lifting device
41—fixing unit
42—lifting means
43—guiding means
44—guide rod

What is claimed is:

1. A device for producing ingots from metal or metal alloy, having
- a. at least one melting device,
- b. at least one permanent mold,
- c. at least one gastight ingot chamber, which is arranged at least partially underneath the at least one permanent mold,
- d. wherein the at least one gastight ingot chamber has a plurality of ingot holding means, which are suitable for receiving at least one ingot in each case,
- e. wherein the ingot holding means are horizontally movable, with the result that
  - i. an ingot holding means is moved to a melting position underneath the at least one permanent mold to receive an ingot, and
  - ii. is then moved to a different location in order to free the melting position for another ingot holding means,
- f. wherein the at least one permanent mold is arranged in such a way that molten metal or metal alloy is fed to it from the at least one melting device.

2. The device as claimed in claim 1, wherein the ingot holding means are arranged on a movable plate.

3. The device as claimed in claim 1, comprising at least one first lifting device, which is suitable for forming a releasable connection to an ingot molded with the aid of the at least one permanent mold and for guiding the ingot into the ingot holding means in the melting position.

4. The device as claimed in claim 1, comprising at least one unloading chamber, which is arranged at least partially above the at least one gastight ingot chamber and has an opening towards the at least one gastight ingot chamber, which is closable in a gastight manner.

5. The device as claimed in claim 4, comprising at least one second lifting device, which is suitable for lifting an ingot out of an ingot holding means in the at least one gastight ingot chamber to an unloading point in the at least one unloading chamber.

6. The device as claimed in claim 1, wherein the at least one melting device has at least one heating means.

7. The device as claimed in claim 6, wherein the at least one heating means is selected from a plasma torch or an electron beam gun.

8. The device as claimed in claim 1, wherein the ingot holding means are movable about a substantially vertical axis of rotation.

9. The device as claimed in claim 1, comprising at least four ingot holding means.

10. A method for producing ingots from metal or metal alloy, comprising the following steps:
- a. melting a metal or a metal alloy to form a melt,
- b. casting an ingot from the melt by means of a permanent mold,
- c. lowering the ingot out of the permanent mold onto an ingot holding means in a gastight ingot chamber, while the ingot holding means is in a melting position,
- d. moving the ingot holding means horizontally, with the result that the ingot holding means occupied by the ingot frees the melting position for another, unoccupied ingot holding means,
- e. allowing the ingot to cool in the ingot holding means, f. moving the occupied ingot holding means to an unloading position in the ingot chamber, and g. unloading the ingot from the ingot chamber at the unloading position.

11. The method as claimed in claim 10, wherein the metal or the metal alloy is selected from Ni, Ti, V, Nb, Ta, Zr, Hf and alloys thereof, and alloys with said metals.

12. The method as claimed in claim 10, wherein the metal alloy comprises TiAl or consists thereof.

13. The method as claimed in claim 10, wherein the method is carried out under inert gas or in a vacuum.

14. The method as claimed in claim 13, wherein the inert gas is helium.

15. The method as claimed in claim 13, wherein the inert gas atmosphere or the vacuum is applied to the ingot chamber.

16. The method as claimed in claim 10, wherein the ingot has a temperature of no more than 500° C. at the time of unloading.

* * * * *